United States Patent [19]

Erickson

[11] 3,942,542

[45] Mar. 9, 1976

[54] COIN-HANDLING DEVICE

[75] Inventor: Gustav F. Erickson, Hot Springs, Ark.

[73] Assignee: UMC Industries, Inc., New York, N.Y.

[22] Filed: May 13, 1974

[21] Appl. No.: 469,108

[52] U.S. Cl. ..... 133/1 R; 133/4 R; 221/186

[51] Int. Cl.[2] ..... G07D 9/00

[58] Field of Search ..... 133/3, 4, 8, 1 R; 221/186; 259/176, 177; 241/178

[56] References Cited

UNITED STATES PATENTS

| | | | |
|---|---|---|---|
| 663,999 | 12/1900 | McKelvey | 259/176 |
| 2,813,705 | 11/1957 | Parish | 259/176 |
| 3,158,361 | 11/1964 | Brenneke | 259/177 |
| 3,612,073 | 10/1971 | Calos | 133/8 R |
| 3,680,566 | 8/1972 | Tanaka | 133/8 R |

*Primary Examiner*—Robert B. Reeves
*Assistant Examiner*—Frederick R. Handren
*Attorney, Agent, or Firm*—Rogers, Ezell & Eilers

[57] ABSTRACT

A coin-receiving drum can be used to carry coins, and also can coact with a support to orient those coins so those coins can be introduced into a coin-dispensing unit. That coin-receiving drum has a number of spaced-apart, coin-receiving recesses therein; and those spaced-apart, coin-receiving recesses open to the exterior of that coin-receiving drum. However, a closure member, which is pivoted to the coin-receiving drum, acts at any given time to close the majority of those spaced-apart, coin-receiving recesses. The support has a driving member and a stop; and that driving member will rotate the coin-receiving drum and the closure member until that closure member engages and is held by that stop; and then that driving member will continue to rotate that coin-receiving drum. That continued rotation of the coin-receiving drum will cause the coins within that coin-receiving drum to enter and be temporarily held within the spaced-apart, coin-receiving recesses, and then be moved to a position wherein the closure member permits them to exit from those spaced-apart, coin-receiving recesses.

27 Claims, 8 Drawing Figures

FIG. 1.
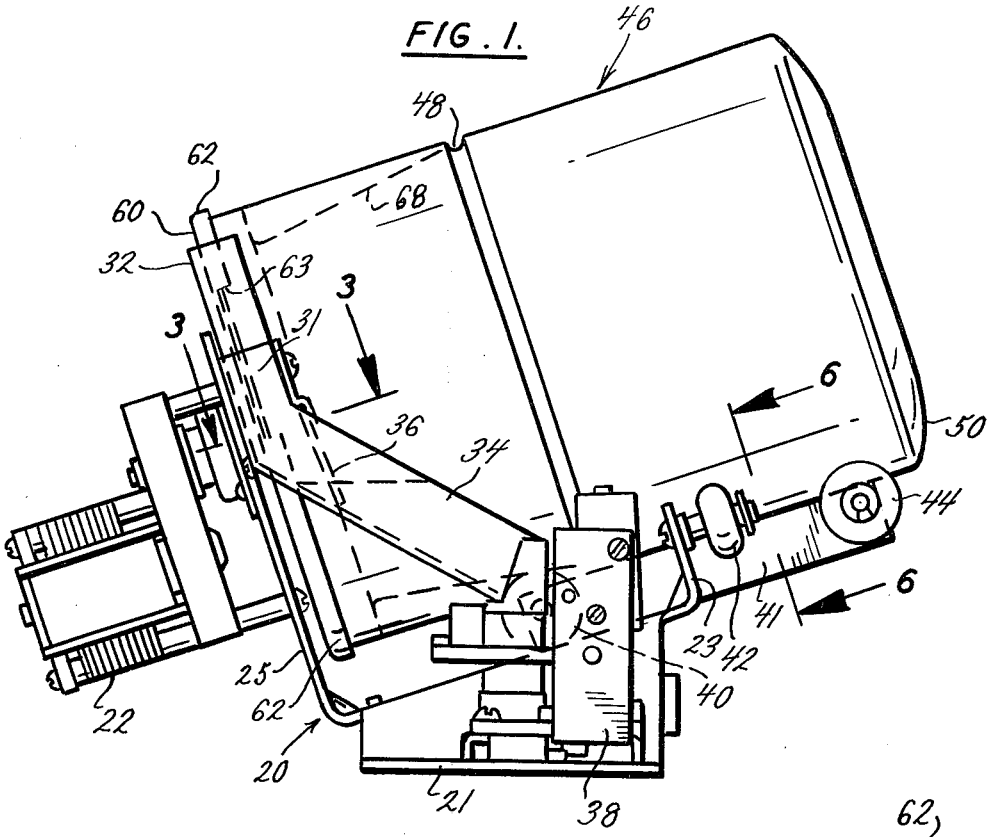
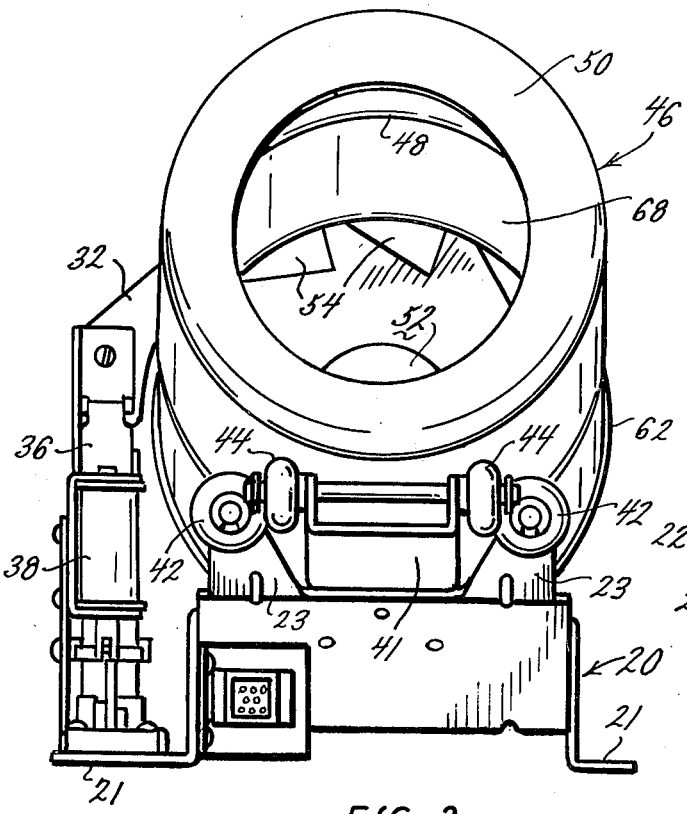
FIG. 2.
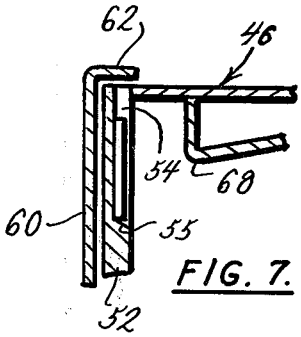
FIG. 7.
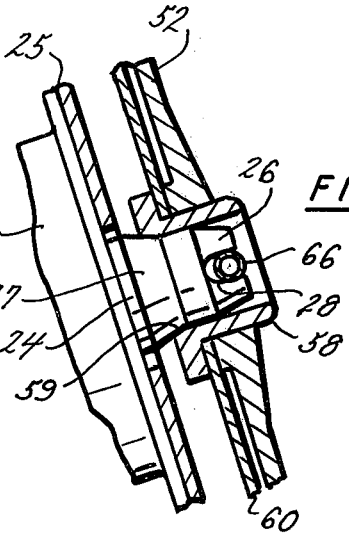
FIG. 8.

COIN-HANDLING DEVICE

FIELD OF THE INVENTION

A coin-orienting device usually has a receptacle which initially holds coins in random fashion; but that receptacle responds to rotation thereof to cause the coins therein to move into spaced-apart sockets or recesses in that receptacle. Thereafter, that receptacle responds to further rotation thereof to permit the coins within those spaced apart sockets or recesses to exit sequentially from those spaced-apart sockets or recesses.

SUMMARY OF THE INVENTION

The present invention provides a coin-receiving drum which can be used to carry coins and which also can coact with a support to orient those coins so those coins can be introduced into a coin-dispensing unit. It is, therefore, an object of the present invention to provide a coin-receiving drum which can be used to carry coins and which also can coact with a support to orient those coins so those coins can be introduced into a coin-dispensing unit.

The coin-receiving drum provided by the present invention has a number of spaced-apart, coin-receiving recesses therein, and those spaced-apart, coin-receiving recesses communicate with the exterior of that coin-receiving drum. However, a closure member is rotatably secured to that coin-receiving drum; and, at any given instant, that closure member acts to close the majority of those spaced-apart coin-receiving recesses. Further, that closure member will coact with a stop on the support to automatically assume a position which will enable coins, that are held within the spaced-apart, coin-receiving recesses in the coin-receiving drum, to exit from those spaced-apart, coin-receiving recesses during rotation of the coin-receiving drum. It is, therefore, an object of the present invention to provide a coin-receiving drum which has a number of spaced-apart, coin-receiving recesses that communicate with the exterior of that coin-receiving drum, and which has a closure member that is rotatably secured thereto and that closes the majority of those spaced-apart, coin-receiving recesses, at any given time, and also to provide interacting surfaces on that closure member and on a suport for that coin-receiving drum which will automatically dispose that closure member in a position wherein coins, that the held within those spaced-apart, coin-receiving recesses, can exit from those spaced-apart, coin-receiving recesses during rotation of that coin-receiving drum.

The support provided by the present invention has a surface thereon which can interact with a surface on the coin-receiving drum to automatically move a torque-receiving surface on that coin-receiving drum into a predetermined engagement with a torque-applying surface on that support. That support also has guiding members which provide a preliminary positioning of the torque-receiving surface on the coin-receiving drum adjacent to, but short of, the desired engagement with the torque-applying surface on that support. Thereafter, that torque-applying surface and that torque-receiving surface will automatically respond to relative movement of that coin-receiving drum and of that support to move into that predetermined engagement. It is, therefore, an object of the present invention to provide a support with a surface thereon which can interact with a surface on a coin-receiving drum to automatically move a torque-receiving surface on that coin-receiving drum into a predetermined engagement with a torque-applying surface on that support, and to provide that support with guiding members which provide a preliminary positioning of the torque-receiving surface on the coin-receiving drum adjacent to, but short of, the desired engagement with the torque-applying surface on the support.

Other and further objects and advantages of the present invention should become apparent from an examination of the drawing and accompanying description.

In the drawing and accompanying description a preferred embodiment of the present invention is shown and described but it is to be understood that the drawing and accompanying description are for the purpose of illustration only and do not limit the invention and that the invention will be defined by the appended claims.

BRIEF DESCRIPTION OF THE DRAWING

In the drawing,

FIG. 1 is a side elevational view of one preferred embodiment of coin-handling device which is made in accordance with the principles and teachings of the present invention, FIG. 2 is an elevational view of the front end of that coin-handling device, FIG. 7 is a sectional view, on the scale of FIG. 3, through the coin-handling device of FIG. 1, and it is taken along the plane indicated by the line 7—7 in FIG. 4, and FIG. 8 is a sectional view, on the scale of FIG. 3 through the coin-handling device of FIG. 1, and it is taken along the plane indicated by the line 8—8 in FIG. 3.

DETAILED DESCRIPTION OF THE PREFERRED EMBODIMENT

Figures 3, 4, 5, 6:
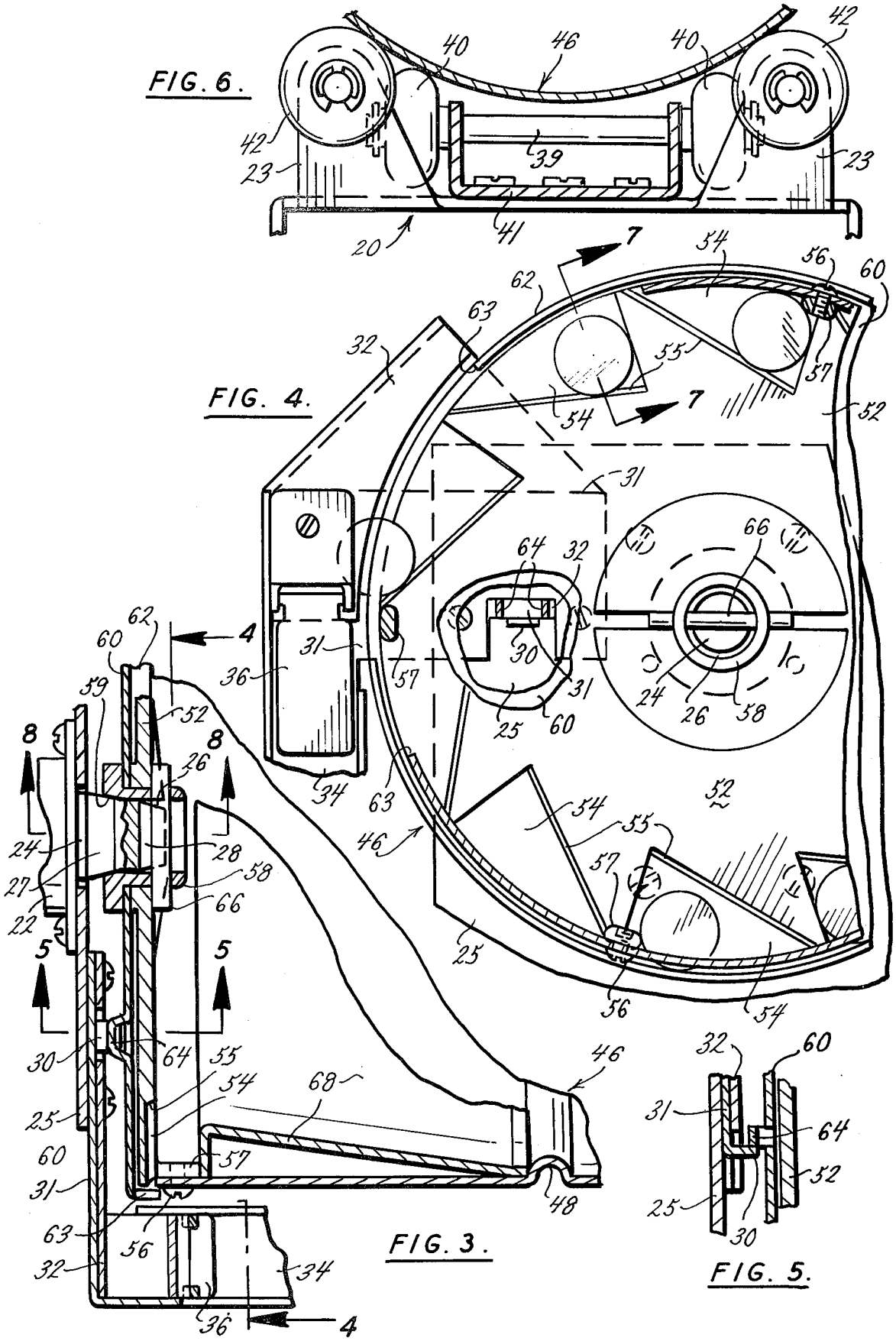
FIG. 3 is a sectional view, on a larger scale, through part of the coin-handling device of FIG. 1, and it is taken along the plane indicated by the line 3—3 in FIG. 1.
FIG. 4 is a sectional view, on the scale of FIG. 3, through the coin-handling device of FIG. 1, and it is taken along the broken plane indicated by the broken line 4—4 in FIG. 3.
FIG. 5 is a sectional view, on the scale of FIG. 3, through a portion of the coin-handling device of FIG. 1, and it is taken along the plane indicated by the line 5—5 in FIG. 3.
FIG. 6 is a sectional view, on the scale of FIG. 3, through the coin-handling device of FIG. 1, and it is taken along the plane indicated by the line 6—6 in FIG. 1.

Referring to the drawing in detail, the numeral 20 generally denotes a base which is shown as a piece of sheet metal that has been formed to have feet 21 which are spaced apart by a bridge-like protion, to have generally-triangular projections 23 adjacent the upper edge of that bridge-like portion, and to have an upwardly-inclined rear wall 25. A gear-type electric motor 22 is mounted at the rear face of the upwardly-inclined rear wall 25; and the output shaft 24 of that motor extends forwardly through that upwardly-inclined rear wall. That output shaft has a frusto-conical forward end 26, a frusto-conical shoulder 27 which is immediately adjacent the upwardly-inclined rear wall 25, and a transverse slot 28 in that frusto-conical forward end. A stop 30 is shown in FIG. 5 as an ear which is bent forwardly from a metal plate 31 that is secured to the front face of the upwardly-inclined rear wall 25; and that metal plate extends to the left in FIG. 4 and has the lower portion thereof bent to define a coin-guiding chute 34. A metal plate 32 is secured to the front face of the metal plate 31; and the former metal plate coacts with the latter metal plate to define a coin-receiving space above and to the left of the stop 30, as that stop is viewed in FIG. 4. The stop 30 extends forwardly through an opening in the metal plate 32, as shown by FIG. 5. A pivoted plate 36 is mounted within the coin-guiding chute 34; and that pivoted plate helps coins, which move downwardly beneath it, to lie flat against the bottom of that coin-guiding chute. The numeral 38 denotes a coin-dispensing unit of standard design which is mounted on one of the feet 21 of the base 20; and that coin-dispensing unit includes a coin tube, a level-sensing switch, a payout slide, and a solenoid. That coin-dispensing unit has the coin tube thereof disposed adjacent the lower end of the coin-guiding chute 34 to receive and stack coins from that chute.

The numeral 40 denotes rollers which are rotatably supported by an elongated pivot 39 that is supported by a bracket 41 which is secured to the bridge-like portion of the base 20, as shown particularly by FIG. 6. The axis of that elongated pivot, and hence of those rollers, is transverse of, and is disposed below the level of, the output shaft 24. The numeral 42 denots rollers which are mounted on pivots that are supported by the triangular projections 23 on the base 20, as shown by FIGS. 1, 2 and 6. Those rollers have the axes thereof parallel to, but displaced below, the level of, the axis of the output shaft 24. The numeral 44 denotes rollers which are mounted on an elongated pivot adjacent the front of the bracket 41; and the axis of that elongated pivot, and hence of those rollers, is parallel to the axis of the elongated pivot 39. As indicated particularly by FIG. 1, the rollers 42 are intermediate the rollers 40 and 44; and the pivots for the rollers 42 are spaced upwardly above a plane defined by the elongated pivots for the rollers 40 and 44.

The base 20, the motor 22, the output shaft 24, the stop 30, the coin-dispensing unit 38, and the rollers 40, 42, and 44 constitute a support which can releasably receive and hold a coin-receiving drum which is generally denoted by the numeral 46. That coin-receiving drum is cylindrical in cross section; and it has an angular groove 48 intermediate the ends thereof, has an inwardly-curved annular flange 50 adjacent the forward end thereof to define a circular opening, and has a rear wall 52. That rear wall has fingers 57 thereon which telescope into the rear end of the coin-receiving drum; and screws 56 extend through openings in the cylindrical wall of that coin-receiving drum to seat in threaded sockets in those fingers. A number of triangular recesses 54 are formed in the forward face of the rear wall 52, as indicated particularly by FIG. 4; and those triangular recesses are spaced apart circumferentially of the coin-receiving drum 46. One wall of each of those triangular recesses is disposed radius-like of that coin-receiving drum; and the other wall of each of those recesses is disposed chord-like of that coin-receiving drum. That other wall is longer than the one wall; and that other wall has a chamfer 55 thereon, which can be planar or arcuate in cross section. Each of the triangular recesses 54 is deeper than a freshly-minted coin of the denomination of coin to be received and held by the coin-receiving drum 46; but each of those triangular recesses is shallower than the depth of two well-worn coins of that denomination. The chamfer 55 on the free edge of the chord-like wall of each triangular recess 54 enables a second coin, which tends to enter and lodge within that triangular recess, to slip out of that triangular recess; and it also tends to facilitate the release of bent coins from that triangular recess.

The radius-like wall of each triangular recess 54 is intended to apply circumferentially-directed forces to any coin lodged within that triangular recess; and the chord-like wall of that triangular recess is intended to serve as a runway for that coin whenever that triangular recess is in its upper left-hand quadrant, as that triangular recess would be viewed in FIG. 4.

The numeral 58 denotes a bushing which has a frusto-conical surface 59 at the rear thereof, as shown particularly by FIGS. 3 and 8; and that frusto-conical surface is complementary to the frusto-conical shoulder 27 on the output shaft 24. That bushing is fixedly secured to the rear wall 52 of the coin-receiving drum 46; and it holds a closure member 60 in assembled relation with the coin-receiving drum 46 but permits relative rotation between that closure member and that coin-receiving drum. The closure member 60 has the form of a circular plate which has a shallow peripheral rim 62 that extends forwardly from that circular plate, as shown particularly by FIG. 7. That rim has a gap 63 therein, as shown by FIGS. 1 and 3; and that gap has an angular extent which is greater than the angular extent of the outer end of any one of the triangular recesses 54 but which is smaller than the sum of the angular extents of any two contiguous recesses 54. In the preferred embodiment shown in the drawing, the rear wall 52 has 10 triangular recesses 54 therein, the angular extent of the outer end of each of those recesses is slightly less than 36°, and the angular extent of the gap 63 in the rim 62 is about 52°. A small portion of the closure member 60 is punched rearwardly to constitute a projection 64; and the radial distance between the center of that projection and the geometric center of the bushing 58 is the same as the radial distance between the center of the stop 30 and the geometric center of the output shaft 24. As a result, whenever that bushing is solidly seated on that output shaft, the stop 30 will be in a position to intercept the projection 64.

As shown by FIG. 7, the front face of the rear wall 52 abuts the rear edge of the cylindrical portion of the coin-receiving drum 46; and the outer ends of the triangular recesses 54 extend to the periphery of that rear wall. As a result, the outer ends of those triangular recesses open directly to the exterior of that coin-receiving drum. Consequently, any coin that enters, or is within, any triangular recess 54 in that rear wall will tend to roll out of that triangular recess whenever the coin-receiving drum 46 is in the position of FIG. 1 and that triangular recess is below a horizontal line passing through the axis of the bushing 58. However, as shown by FIG. 7, the rim 62 on the closure member 60 extends forwardly from that closure member to block the outer ends of the majority of the triangular recesses 54.

The numeral 66 denotes a pin which passes through aligned openings in the bushing 58; and that pin bisects the cylindrical passage through that bushing. That pin is dimensioned to fit within the slot 28 in the front of the output shaft 24, as shown particularly by FIG. 8.

The numeral 68 denotes a frustro-conical guide which is telescoped within the cylindrical portion of the coin-receiving drum 46. One end of that guide abuts the annular groove 48, and the other end of that guide abuts the fingers 57, as shown by FIG. 3; and hence that guide is held against axial movement relative to the coin-receiving drum 46. Each of the fingers 57 has an axial dimension greater than one-half the diameter of the denomination of coin which is to be held within the coin-receiving drum 46; and hence those fingers coact with the guide 68 to define an annular space which is adjacent the rear wall 52 and which has an axial dimension greater than one-half the diameter of the denomination of coin which is to be held within that coin-receiving drum.

The cylindrical passage through the bushing 58 is smaller than the diameter of the denomination coin to be held within the coin-receiving drum 46; and hence coins cannot escape through that cylindrical passage. The rim 62 of the closure member 60 always effectively blocks the outer ends of at 8 of the 10 triangular recesses 54; and hence, whenever the gap 63 in that rim is disposed adjacent the upper surface of the coin-receiving drum 46, that coin-receiving drum will be able to hold coins. As a result, whenever that coin-receiving drum is carried so the gap 63 in the rim 62 is adjacent the upper surface of that coin-receiving drum and so the lowermost edge of the opening defined by the inwardly-directed annular flange 50 is higher than the angle of rest of the coins within that coin-receiving drum, that coin-receiving drum can be used as a carrier for coins. This is desirable; because it enables a serviceman for a coin-dispensing machine to fill a number of coin-receiving drums 46 before he starts on his route and then merely replace each partly-exhausted coin-receiving drum on his route with a filled coin-receiving drum. Such an arrangement reduces the "down time" of those coin-dispensing machines, reduces the amount of time which the service man must spend at each location, and avoids the need of transferring coins from a large container to the coin-receiving drum of each coin-dispensing machine.

To replace a partly-empty coin-receiving drum 46 with a full coin-receiving drum, the service man need only insert one hand in the opening defined by the inwardly-extending flange 50 and apply a forwardly-directed axial force to that coin-receiving drum. Thereupon, the bushing 58 will telescope forwardly along the output shaft 24; and then the weight of the coin-receiving drum 46 and of the coins therein will tend to move the lower surface of that coin-receiving drum downwardly into engagement with the rollers 40. If the operator is holding the forward end of that coin-receiving drum slightly above the position shown in FIG. 1, the surface of that coin-receiving drum will be above, and out of engagement with, the rollers 42 and 44; and the bulk of the weight of that coin-receiving drum will be supported by the rollers 40. Those rollers will facilitate easy movement of the coin-receiving drum 46 forwardly relative to the support 20. When the rim 62 of the closure member 60 engages the rollers 40, the serviceman can tilt the forward end of that coin-receiving drum downwardly until the lower surface of that coin-receiving drum engages and is essentially supported by the rollers 44. Thereafter, the serviceman can roll the coin-receiving drum 46 forwardly until he can dispose his other hand in engagement with the closure member 60 and with the rear surface of that coin-receiving drum; and, thereupon, the serviceman can lift the partly-empty coin-receiving drum from the support 20.

To insert a full coin-receiving drum 46, the serviceman need only move the rear wall of that coin-receiving drum rearwardly of the rollers 44, permit the major portion of the weight of that coin-receiving drum and of the coins therein to be borne by those rollers, and then permit gravity to urge that coin-receiving drum toward the output shaft 24. As the closure member 60 engages the rollers 42, the serviceman can tilt the axis of the coin-receiving drum 46 far enough to permit that closure member to clear those rollers; and then he can continue to permit the rollers 44 to support the major portion of the weight of that coin-receiving drum and of the coins therein. After the closure member 60 has moved rearwardly beyond the rollers 40, the serviceman can permit the weight of the coin-receiving drum 46 and of the coins therein to move the lower surface of that coin-receiving drum downwardly into engagement with those rollers, and then that serviceman can raise forward end of that coin-receiving drum sufficiently to keep the bottom of that coin-receiving drum from resting upon the rollers 42 while the permits gravity to continue to move that coin-receiving drum rearwardly. The rollers 40 will hold the uppermost portion of the frusto-conical surface 59 in the bushing 58 slightly above the upper most portion of the leading edge of the frusto-conical surface 26 on the output shaft 24; and those rollers also will guide that bushing into approximate alignment with that output shaft. Consequently, without any need of the serviceman applying guiding forces to the coin-receiving drum 46, the rollers 40 will cause the frusto-conical surface 59 of the bushing 58 to start teescoping over the frusto-conical leading edge 26 of the output shaft 24. At such time, the pin 66 may or may not be aligned with the slot 28 in the front end of that output shaft.

As long as the surface of the coin-receiving drum 46 is in engagement with the rollers 40, the axis of the bushing 58 will be disposed a fraction of an inch below the level of the axis of the output shaft 24, and the frusto-conical surface 59 will be displaced from the frusto-conical shoulder 27. At such time, the coin-receiving drum 46 will be close to, but will not be in, a position wherein it can transfer coins to the coin-guiding chute 34. However, once the rollers 40 have guided that coin-receiving drum close to its coin-transferring position, the serviceman will momentarily energize the motor 22. The resulting counter clockwise rotation of the output shaft 24 in FIG. 4 will develop sliding friction, rather than static friction, between the frusto-conical forward end 26 of that output shaft and the frusto-conical surface 59 in the bushing 58; and that sliding friction will enable gravity to cause that bushing to successively slide to the left along that frusto-conical forward end, slide to the left along the cylindrical portion of the output shaft 24, and then slide to the left along the frusto-conical shoulder 27. Specifically, the weight of the coin-receiving drum 46 and of the coins therein will develop a downwardly-acting force which will have a component of force that is coaxial with the output shaft 24; and that component of force will coact with the sliding friction between that output shaft and the bushing 58 to enable the frusto-conical surface 59 to move to the left until it seats on the frusto-conical shoulder 27. At such time the bearings, not shown, for the output shaft 24 and the frusto-conical shoulder 27 will fully withstand any and all axial thrusts which the weight of the coin-receiving drum 46 and of the coins therein can apply to that output shaft.

As the weights of the coin-receiving drum 46 and of the coins therein coact with the sliding friction between the frusto-conical surface 59 in the bushing 58 and the frusto-conical end 26 of the output shaft 24 to cause that bushing to shift to the left, the pin 66 which is held by that bushing will approach the slot 28 in that output shaft. If that slot is not aligned with that pin, further shifting of the coin-receiving drum 46 to the left will be halted; but, as soon as that slot is aligned with that pin, that pin will move into that slot. Thereafter, the end wall 52 and the cylindrical portion of the coin-receiving drum 46 will rotate with the output shaft 24.

As the pin 46 moves into the slot 26 in the output shaft 24, the closure member 60 will tend to rotate in the counter clockwise direction with the coin-receiving drum 46 because of the frictional engagement between that closure member and the bushing 58. The gap 63 in the rim 62 of that closure member will initially be at the top of that closure member — to keep coins from falling out of the triangular recesses 54 in the lower portion of the end wall 52. However, as that closure member responds to the frictional forces, between itself and the bushing 58, to rotate in the counter clockwise direction in FIG. 4, the projection 64 on that closure member will engage the stop 30, as shown particularly by FIGS. 4 and 5. Thereupon, further rotation of that closure member will be halted; and, at such time, the gap 63 will be in register with the coin-receiving space which is defined by the metal plates 31 and 32. This means that coins which are moved into register with that gap can enter that coin-receiving space; and those coins will move downwardly past the pivoted plate 36 and into the coin tube of the coin-dispensing unit 38.

Initially, the coin-receiving drum 46 will hold the coins therein in random fashion in the lower portion thereof; but the weights of those coins will coact with the rotation of that coin-receiving drum to force some of those coins into face-to-face alignment with the rear wall 52. As that rear wall rotates, some of those coins will enter the triangular recesses 54 in the forward face of that rear wall; and the radius-like walls of those triangular recesses will move those coins upwardly into position in register with the gap 63 in the rim 62. As each triangular recess approaches that gap, the chord-like wall of that triangular recess will act as a runway for the coin in that triangular recess; and that coin will roll outwardly through the open end of that triangular recess and into the coin-receiving space defined by the metal plates 31 and 32. The chamfer 55 on the chord-like wall of each triangular recess 54 will enable a second coin, or a bent coin, in that triangular recess to work its way out of that triangular recess and back into the coin-receiving drum 46 before it reaches the gap 63. In that way, the chamfer 55 tends to keep bent coins reaching the coin tube of the coin-dispensing unit 38 and to keep second coins in the triangular recesses 54 from reaching the gap 63. As the various coins pass successively through the coin-receiving chute and the coin-guiding chute 34, those coins will be oriented and aligned; and they will fall into the coin tube of the coin-dispensing unit 38 in the form of a neat stack. Consequently, the coin-handling device of the present invention is able to take coins which are held in random fashion within the coin-receiving drum 46 and stack them neatly within the coin tube of the coin-dispensing unit 38.

As the motor 22 rotates the coin-receiving drum 46 in the counter clockwise direction in FIG. 4, the coins at the right-hand side of the axis of the output shaft 24 will rise above the level of the coins at the left-hand side of that axis. Further, some of those coins can tend to slide, roll or be moved into position adjacent the gap 63 in the rim 62 on the closure member 60; and those coins can tend to keep some of the coins within the triangular recesses 54 from rolling out of those triangular recesses and into the coin-receiving space defined by the metal plates 31 and 32. In some instances, coins adjacent the gap 63 can tend to form a "bridge" which impedes free rolling of coins out of the triangular recesses 54; and, in other instances, coins adjacent that gap can apply frictional forces to the coins within those triangular recesses which impede free rolling of those coins out of those triangular recesses. In either of those instances, coins will not freely roll out of the triangular recesses 54 and into the coin-receiving space defined by the metal plates 31 and 32 even though the coin-receiving drum 46 continues to rotate. As pointed out in detail in the patent application Ser. No. 520,973 of Ashok K. Gupta which is entitled CIRCUITRY FOR COIN-HANDLING SYSTEM, and which was filed on Nov. 5, 1975, it is possible to assure free rolling of coins out of the triangular recesses 54 and through the gap 63 by recurrently de-energizing the motor 22. Each time that motor is de-energized, the weight of the coins which are disposed to the right of the axis of the output shaft 24 in FIG. 4 will enable the coin-receiving drum 46 to apply forces to that output shaft which will tend to rotate that output shaft and that coin-receiving drum in the clockwise direction. Such clockwise direction of that coin-receiving drum will be quite limited in extent; but that clockwise rotation will tent to permit any "bridge-forming" coins to move away from the gap 63, and also will reduce the frictional forces between coins within the triangular recesses 54 and the adjacent coins. As a result, renewed rotation of the coin-receiving drum 46 in the counter clockwise direction in FIG. 4 will permit coins to roll freely out of the triangular recesses 54.

The motor 22 will cause the coin-receiving drum 46 to raise coins upwardly to, and to permit those coins to roll through, the gap 63 until the level of the coins within the tube of the coin dispensing unit 38 reaches the actuator of the level-sensing switch of that coin dispensing unit. When the uppermost coin in that coin tube continuously holds that actuator in its outer position, the motor 22 will be de-energized, and the coin-receiving drum 46 will come to rest, until further coins are paid out of that coin tube.

The frusto-conical guide 68 which is mounted within the cylindrical portion of the coin-receiving drum 46, as shown by FIG. 3, is helpful in facilitating the positioning of coins so they are generally parallel to the rear wall 52. Specifically as the coins, which are held in random fashion within the coin-receiving drum 46, progressively move toward the rear wall 52, those coins will receive support from that frusto-conical guide; but, as the center-line of any coin moves to the left beyond the left-hand end of that frusto-conical guide, gravity will tend to cause that coin to move downwardly into the annular space between the left-hand end of that guide and that rear wall. Thereafter, the weights of the coins which are located radially inwardly of any coin, that has moved to the left beyond the left-hand end of the frusto-conical guide 68, will tend to force the left-hand portion of the periphery of that coin downwardly into the annular recess adjacent the fingers 57 — and hence will tend to force that coin to move into parallism with the rear wall 52. Subsequently, the presence of adjacent coins will tend to cause that coin to enter any coin-free triangular recess 54 which approaches that coin.

The fingers 57 perform three functions: namely, they coact with the screws 56 to secure the rear wall 52 to the cylindrical portion of the coin-receiving drum 46, they help position the frusto-conical guide 68 within that coin-receiving drum, and they help stir up the coins within that coin-receiving drum as that coin-receiving drum rotates. In performing the latter function, those fingers minimize the likelihood of coins bridging the gap 63 or of applying undue fructional forces to the coins within the triangular recesses 54.

The output shaft 24 is very useful in helping to automatic raise the inner end of the coin-receiving drum 46 into register with the axis of that output shaft, and hence in raising the lower surface of that coin-receiving drum out of engagement with the rollers 40. However, if desired, a stationary projection having the general form of the output shaft 24 could be mounted on the upwardly inclined rear wall 25 of the base 20, and the rollers 42 could be used to apply rotating forces to the coin-receiving drum 46. In such event, the rollers 40 would guide the bushing 58 into position adjacent the frusto-conical outer end of that projection, and then the rollers 42 would rotate that coin-receiving drum to provide the sliding friction which would be relied upon to enable the bushing 58 to move into full engagement with that projection.

The rollers 40 and 44 are very helpful in relieving the serviceman of the need of fully supporting the coin-receiving drum 46 while he is moving that coin-receiving drum into and out of position adjacent the output shaft 24. Further, those rollers relieve the serviceman of the need of lifting a heavy load while that load is at arms-length from him and while that load is within a coin-dispensing machine. Consequently, those rollers minimize the energy which must be expended, and the strains which must be withstood, by the serviceman.

The diameter of the coin-receiving drum 46 and the sizes of the triangular recesses 54 will be functions of the sizes of the coins to be held within, and then released by, that coin-receiving drum. For example, a coin-receiving drum 46 which was intended to hold, and then release, U.S. dimes would usually have a smaller diameter and would have smaller triangular recesses 54 than would a coin-receiving drum that was intended to hold, and then release, U.S. quarters. However, a coin-receiving drum 46 which was intended to hold, and then release, U.S. quarters could also be used to hold, and then release, U.S. nickels.

Whereas the drawing and accompanying description have shown and described a preferred embodiment of the present invention, it should be apparent to those skilled in the art that various changes can be made in the form of the invention without affecting the scope thereof.

What I claim is:

1. A coin-handling device which comprises a support, a coin-receiving drum that can be selectively moved into and out of a predetermined coin-releasing position adjacent said support and that can hold a plurality of coins in predetermined spaced-apart locations, a closure member which is carried by said coin-receiving drum and which moves with said coin-receiving drum as said coin-receiving drum is moved into and out of said predetermined coin-releasing position adjacent said support, said closure member being secured to but being movable relative to said coin-receiving drum, an exit for coins, said closure member permitting coins which are held in said predetermined spaced apart locations by said coin-receiving drum to move from said coin-receiving drum to and through said exit whenever said coin-receiving drum is in said coin-releasing position and said closure member is in a predetermined stationary position and relative movement is provided between said coin-receiving drum and said closure member, interacting surfaces on said support and on said closure member which hold said closure member in said predetermined stationary position whenever said coin-receiving drum is in said predetermined coin-releasing position adjacent said support, and means to provide relative movement between said coin-receiving drum and said closure member while said closure member is held against movement relative to said support to permit said coins which are held in said predetermined spaced apart locations by said coin-receiving drum to move to and through said exit and thereby be freed from said coin-receiving drum.

2. A coin-handling device as claimed in claim 1 wherein said coin-receiving drum has a plurality of circumferentially-displaced recesses therein to hold said coins in said predetermined spaced-apart locations, wherein said closure member blocks the majority of said circumferentially-displaced recesses at any given time, and wherein relative movement between said coin-receiving drum and said closure member successively unblocks succeeding ones of said circumferentially-displaced recesses and thereby successively permits coins which are held in said succeeding ones of said circumferentially-displaced recesses to successively exit from said succeeding ones of said circumferentially-displaced recesses.

3. A coin-handling device as claimed in claim 1 wherein said coin-receiving drum has a plurality of circumferentially-displaced recesses therein to hold said coins in said predetermined spaced-apart location, and wherein said closure member blocks the majority of said circumferentially-displaced recesses, but leaves at least one of said circumferentially-displaced recesses unblocked, at any given time.

4. A coin-handling device as claimed in claim 1 wherein said closure member blocks the majority of said predetermined spaced-apart locations at any given time, and thereby enables said coin-receiving drum to be used to carry coins.

5. A coin-handling device as claimed in claim 1 wherein said closure member is a plate with a shallow rim thereon, wherein said spaced-apart locations are adjacent one end of said coin-receiving drum, wherein said closure member is located adjacent said one end of said coin-receiving drum and has said shallow rim thereon telescoped over a short portion of the length of the periphery of said coin-receiving drum, and wherein said shallow rim blocks all but two of said predetermined spaced-apart locations at any given time.

6. A coin-handling device as claimed in claim 1 wherein said means rotates said coin-receiving drum relative to said support, wherein said closure member tends to rotate with said coin-receiving drum, and wherein said interacting surfaces on said support and on said closure member act to halt rotation of said closure member with said coin-receiving drum.

7. A coin-handling device as claimed in claim 1 wherein circumferencially-shaped recesses in said coin-receiving drum hold said plurality of coins in said predetermined spaced-apart locations, wherein one wall of each of said circumferentially-spaced recesses is disposed chord-like relative to said coin-receiving drum, and wherein said one walls of said circumferentially-spaced recesses serve as coin runways for said plurality of coins as said plurality of coins exit from said coin-receiving drum.

8. A coin-handling device as claimed in claim 1 wherein circumferentially-spaced recesses in said coin-receiving drum hold said plurality of coins in said predetermined spaced-apart locations, wherein one wall of each of said circumferentially-spaced recesses is disposed chord-like relative to said coin-receiving drum, wherein said one walls of said circumferentially-spaced recesses serve as coin runways for said plurality of coins as said plurality of coins exit from said coin-receiving drum, and wherein the free edges of said one walls of said circumferentially-spaced recesses incline downwardly to permit bent coins to roll off of said one walls before they can exit from said coin-receiving drum.

9. A coin-handling device which comprises a support, a coin-receiving drum that is movable into and out of a predetermined position adjacent said support, a driving member that can rotate said coin-receiving drum relative to said support whenever said coin-receiving drum is in said predetermined position, interacting surfaces on said coin-receiving drum and on said support which initially help hold said coin-receiving drum immediately adjacent to, but not in, said predetermined position, and further interacting surfaces on said driving member and on said coin-receiving drum which can respond to the holding of said coin-receiving drum immediately adjacent said predetermined position by the first said interacting surfaces and to rotation of said driving member relative to said coin-receiving drum to automatically cause said coin-receiving drum to move into said predetermined position.

10. A coin-handling device as claimed in claim 9 wherein the first said interacting surfaces include the exterior of said coin-receiving drum and rollers that engage said exterior of said coin-receiving drum to initially help support said coin-receiving drum.

11. A coin-handling device as claimed in claim 9 wherein the first said interacting surfaces include the exterior of said coin-receiving drum, rollers that engage said exterior of said coin-receiving drum, and portions of said further interacting surfaces.

12. A coin-handling device as claimed in claim 9 wherein the first said interacting surfaces include the exterior of said coin-receiving drum and rollers that engage said exterior of said coin-receiving drum to initially help support said coin-receiving drum, and wherein said first said interacting surfaces hold said coin-receiving drum so gravity urges said coin-receiving drum toward said predetermined position.

13. A coin-handling device as claimed in claim 9 wherein the first said interacting surfaces include the exterior of said coin-receiving drum and rollers that engage said exterior of said coin-receiving drum to initially help support said coin-receiving drum, and wherein said rollers help support one end of said coin-receiving drum while said further interacting surfaces help support the other end of said coin-receiving drum.

14. A coin-handling device as claimed in claim 9 wherein said first said interacting surfaces hold said coin-receiving drum so gravity urges said coin-receiving drum toward said predetermined position.

15. A coin-handling device as claimed in claim 9 wherein said first said interacting surfaces also help hold said coin-receiving drum in said predetermined position.

16. A coin-handling device as claimed in claim 9 wherein the first said interacting surfaces include the exterior of said coin-receiving drum and rollers that engage said exterior of said coin-receiving drum to initially help support said coin-receiving drum, and wherein said rollers have the axes thereof parallel to the axis of said coin-receiving drum whenever said coin-receiving drum is in said predetermined position.

17. A coin-handling device as claimed in claim 9 wherein one of said further interacting surfaces is a frusto-conical surface on said driving member and another of said further interacting surfaces is a bushing in said coin-receiving drum.

18. A coin-handling device as claimed in claim 9 wherein one of said further interacting surfaces is a frusto-conical surface on said driving member and another of said further interacting surfaces is a bushing in said coin-receiving drum, wherein said bushing telescopes over and is driven by said driving member, and wherein said bushing drives said coin-receiving drum, whereby said bushing performs the dual functions of helping said coin-receiving drum move into said predetermined position and of helping drive said coin-receiving drum.

19. A coin-handling device which comprises a support, a coin-receiving drum that has means to hold a plurality of coins in predetermined spaced-apart locations therein, said coin-receiving drum being movable into and out of a predetermined position adjacent said support, a driving member that can rotate said coin-receiving drum relative to said support whenever said coin-receiving drum is in said predetermined position, interacting surfaces on said coin-receiving drum and on said support which help guide said coin-receiving drum into an initial position immediately adjacent said predetermined position wherein said driving member can rotate without rotating said coin-receiving drum, said interacting surfaces also initially helping hold said coin-receiving drum immediately adjacent to, but not in, said predetermined position, said interacting surfaces including rollers on said support, and further interacting surfaces on said driving member and on said coin-receiving drum which respond to the holding of said coin-receiving drum in said initial position immediately adjacent said predetermined position by the first said interacting surfaces and to rotation of said driving member relative to said coin-receiving drum to automatically cause said coin-receiving drum to move from said initial position into said predetermined position as said driving member rotates relative to said coin-receiving drum and thereby can automatically cause said coin-receiving drum to start rotating with said driving member.

20. A coin-handling device which comprises a support, a coin-receiving drum that has means to hold a plurality of coins in predetermined spaced-apart locations therein, said coin-receiving drum being movable into and out of a predetermined position adjacent said support, a driving member that can rotate said coin-receiving drum relative to said support whenever said coin-receiving drum is in said predetermined position, and rollers which guide said coin-receiving drum into an intial position adjacent said predetermined position wherein said driving member can rotate without rotating said coin-receiving drum, and interacting surfaces on said driving member and on said coin-receiving drum which can act while said coin-receiving drum is in said initial position to automatically cause said coin-receiving drum to move from said initial position into said predetermined position as said driving member rotates relative to said coin receiving drum, the axes of said rollers being transverse of the axis of said coin-receiving drum.

21. A coin-handling device which comprises a support, a coin-receiving drum that has means to hold a plurality of coins in predetermined spaced-apart locations therein, said coin-receiving drum being movable into and out of a predetermined position adjacent said support, a driving member that can rotate said coin-receiving drum relative to said support whenever said coin-receiving drum is in said predetermined position, interacting surfaces on said coin-receiving drum and on said support and further interacting surfaces on said driving member and on said coin-receiving drum which support said coin-receiving drum while said driving member rotates said coin-receiving drum relative to said support, said coin-receiving drum being disposable in an initial position which is adjacent to said predetermined position and wherein said interacting surfaces on said coin-receiving drum and on said support help support said coin-receiving drum but said driving member does not rotate said coin-receiving drum, rollers which guide said coin-receiving drum toward said predetermined position, and said rollers having the axes thereof transverse of the axis of said coin-receiving drum.

22. A coin-handling device which comprises a support, a coin-receiving drum that has means to hold a plurality of coins in predetermined spaced-apart locations therein, said coin-receiving drum being movable into and out of a predetermined position adjacent said support, a driving member that can rotate said coin-receiving drum relative to said support whenever said coin-receiving drum is in said predetermined position, interacting surfaces on said coin-receiving drum and on said support and further interacting surfaces on said driving member and on said coin-receiving drum which support said coin-receiving drum while said driving member rotates said coin-receiving drum relative to said support, said coin-receiving drum being disposable in an initial position which is adjacent to said predetermined position and wherein said interacting surfaces on said coin-receiving drum and on said support help support said coin-receiving drum but said driving member does not rotate said coin-receiving drum, rollers which guide said coin-receiving drum toward said predetermined position, and said rollers having the axes thereof transverse of the axis of said coin-receiving drum, and the first said and said further interacting surfaces holding said coin-receiving drum up out of engagement with said rollers whenever said coin-receiving drum is in said predetermined position.

23. A coin-handling device which comprises a support, a coin-receiving drum that has means to hold a plurality of coins in predetermined spaced-apart locations therein, said coin-receiving drum being movable into and out of a predetermined position adjacent said support, a driving member that can rotate said coin-receiving drum relative to said support whenever said coin-receiving drum is in said predetermined position, and rollers which guide said coin-receiving drum into an initial position adjacent said predetermined position wherein said driving member can rotate without rotating said coin-receiving drum, and interacting surfaces on said driving member and on said coin-receiving drum which can act while said coin-receiving drum is in said initial position to automatically cause said coin-receiving drum to move from said initial position into said predetermined position as said driving member rotates relative to said coin receiving drum, two of said rollers being close to said driving member, two further of said rollers being remote from said driving member, said rollers defining a plane, additional rollers being located above the level of said plane, and said additional rollers helping hold said coin-receiving drum up out of engagement with the first said two rollers and said further two rollers whenever said coin-receiving drum is in said predetermined position.

24. A coin-handling device which comprises a support, a coin-receiving drum that has means to hold a plurality of coins in predetermined spaced-apart locations therein, said coin-receiving drum being movable into and out of a predetermined position adjacent said support, a driving member that can rotate said coin-receiving drum relative to said support whenever said coin-receiving drum is in said predetermined position, and rollers which guide said coin-receiving drum into an initial position adjacent said predetermined position wherein said driving member can rotate without rotating said coin-receiving drum, and interacting surfaces on said driving member and on said coin-receiving drum which can act while said coin-receiving drum is in said initial position to automatically cause said coin-receiving drum to move from said initial position into said predetermined position as said driving member rotates relative to said coin receiving drum, two of said rollers being close to said driving member, two further of said rollers being remote from said driving member, said rollers defining a plane, additional rollers being located above the level of said plane, said additional rollers helping hold said coin-receiving drum up out of engagement with the first said two rollers and said further two rollers whenever said coin-receiving drum is in said predetermined position, said first said two rollers and said further two rollers having parallel axes that are disposed transversely of the axis of said driving member, and said additional rollers having the axes thereof parallel to the axis of said driving member.

25. A coin-handling device which comprises a support, a coin-receiving drum that has means to hold a plurality of coins in predetermined spaced-apart locations therein, said coin-receiving drum being movable into and out of a predetermined position adjacent said support, a driving member that can rotate said coin-receiving drum relative to said support whenever said coin-receiving drum is in said predetermined position, and rollers which guide said coin-receiving drum into an initial position adjacent said predetermined position wherein said driving member can rotate without rotating said coin-receiving drum, and interacting surfaces on said driving member and on said coin-receiving drum which can act while said coin-receiving drum is in said initial position to automatically cause said coin-receiving drum to move from said initial position into said predetermined position as said driving member rotates relative to said coin receiving drum, two of said rollers being close to said driving member, two further of said rollers being remote from said driving member, said rollers defining a plane, additional rollers being located above the level of said plane, said additional rollers helping hold said coin-receiving drum up out of engagement with the first said two rollers and said further two rollers whenever said coin-receiving drum is in said predetermined position, said two further rollers being capable of coacting to help support said coin-receiving drum as said coin-receiving drum is rested on said support remote from said predetermined position, said coin-receiving drum being capable of having the axis thereof tilted in one direction relative to the horizontal to enable a portion of said coin-receiving drum to pass above and out of engagement with said additional rollers, said coin-receiving drum being capable of having said axis thereof tilted in the opposite direction relative to the horizontal and of having the first said portion thereof rested on the first said two rollers to enable a further portion of said coin-receiving drum to pass above and out of engagement with said additional rollers, and said first said two rollers and said additional rollers being capable of supporting said coin-receiving drum when said coin-receiving drum is just short of said predetermined position.

26. A coin-handling device which comprises a support, a coin-receiving drum that has means to hold a plurality of coins in predetermined spaced-apart locations therein, said coin-receiving drum being movable into and out of a predetermined position adjacent said support, a driving member that can rotate said coin-receiving drum relative to said support whenever said coin-receiving drum is in said predetermined position, and rollers which guide said coin-receiving drum into an initial position adjacent said predetermined position wherein said driving member can rotate without rotating said coin-receiving drum, and interacting surfaces on said driving member and on said coin-receiving drum which can act while said coin-receiving drum is in said initial position to automatically cause said coin-receiving drum to move from said initial position into said predetermined position as said driving member rotates relative to said coin-receiving drum, two of said rollers being close to said driving member, two further of said rollers being remote from said driving member, said rollers defining a plane, additional rollers being located above the level of said plane, said additional rollers helping hold said coin-receiving drum up out of engagement with the first said two rollers and said further two rollers whenever said coin-receiving drum is in said predetermined position, and said additional rollers being located intermediate the first said two rollers and said two further rollers.

27. A coin-handling device which comprises a support, a coin-receiving drum that is selectively movable into and out of a predetermined position adjacent said support, interacting surfaces on said coin-receiving drum and on a driving member and on said support which provide three points of support for said coin-receiving drum and thereby hold said coin-receiving drum in said predetermined position, said driving member being engaged by said coin-receiving drum and being adapted to rotate said coin-receiving drum relative to said support whenever said coin-receiving drum is in said predetermined position, and further interacting surfaces which can hold said coin-receiving drum in an initial position adjacent said predetermined position, one of said further interacting surfaces being on said driving member, said driving member also helping to support said coin-receiving drum while it rotates said coin-receiving drum relative to said support.

* * * * *